US006782651B1

(12) United States Patent
Walker et al.

(10) Patent No.: US 6,782,651 B1
(45) Date of Patent: Aug. 31, 2004

(54) BREACHING TOOL

(75) Inventors: Ronald N. Walker, Cobb, WI (US); Douglas L. Burche, Olathe, KS (US)

(73) Assignee: Inpromarketing Corp., Cobb, WI (US)

( * ) Notice: Subject to any disclaimer, the term of this patent is extended or adjusted under 35 U.S.C. 154(b) by 5 days.

(21) Appl. No.: 10/365,289

(22) Filed: Feb. 12, 2003

(51) Int. Cl.[7] ..... F41C 21/00
(52) U.S. Cl. ..... 42/79
(58) Field of Search ..... 42/79, 77, 76.01; 89/14, 29

(56) References Cited

U.S. PATENT DOCUMENTS

| | | | | | |
|---|---|---|---|---|---|
| 2,092,649 | A | | 9/1937 | Jung | 42/79 |
| D158,795 | S | * | 5/1950 | Powell | D22/108 |
| 2,712,193 | A | * | 7/1955 | Mathis | 42/79 |
| 2,894,348 | A | * | 7/1959 | Cutts | 42/79 |
| 2,932,915 | A | * | 4/1960 | Wilson | 42/79 |
| 2,977,702 | A | * | 4/1961 | Schacht | 42/79 |
| 2,989,815 | A | * | 6/1961 | Hare | 42/79 |
| 3,045,379 | A | | 7/1962 | Cutts | 42/79 |
| 3,161,979 | A | * | 12/1964 | Lowe | 42/79 |
| 4,151,671 | A | * | 5/1979 | McPeak | 42/79 |
| 4,510,843 | A | * | 4/1985 | Rabatin | 89/14.4 |
| 4,643,073 | A | * | 2/1987 | Johnson | 89/14.3 |
| 4,685,235 | A | * | 8/1987 | Bunning et al. | 42/75.02 |
| 4,707,942 | A | * | 11/1987 | Peters | 42/77 |
| 4,939,977 | A | * | 7/1990 | Stroup | 89/14.4 |
| 5,119,716 | A | * | 6/1992 | Bartolles | 89/14.3 |
| 5,157,211 | A | * | 10/1992 | Mossberg | 42/79 |
| 5,164,535 | A | * | 11/1992 | Leasure | 89/14.4 |
| 5,317,825 | A | | 6/1994 | Vatterott et al. | 42/79 |
| 5,333,529 | A | * | 8/1994 | Brockman | 89/14.3 |
| 5,452,535 | A | | 9/1995 | See et al. | 42/79 |
| 5,631,438 | A | * | 5/1997 | Martel | 89/14.3 |
| 5,685,102 | A | * | 11/1997 | Latka | 42/85 |
| 5,798,474 | A | * | 8/1998 | Rogers et al. | 89/14.05 |
| 6,052,935 | A | | 4/2000 | Howard | 42/79 |
| 6,128,846 | A | | 10/2000 | Walker et al. | 42/79 |
| 6,295,752 | B1 | * | 10/2001 | Havlock | 42/76.01 |
| 6,385,891 | B1 | * | 5/2002 | Rabatin | 42/79 |
| 6,425,310 | B1 | * | 7/2002 | Champion | 89/14.3 |
| 6,557,290 | B2 | * | 5/2003 | Kumler | 42/79 |
| 2001/0049996 | A1 | * | 12/2001 | Fluhr | 89/14.4 |

* cited by examiner

*Primary Examiner*—Michael J. Carone
*Assistant Examiner*—Denise Buckley
(74) *Attorney, Agent, or Firm*—Sonnenschein Nath & Rosenthal

(57) ABSTRACT

A breaching tool assembly is provided for use with a shotgun barrel including a cylindrical carrier tube with a first externally threaded portion at one end for threadingly engaging an internal thread in the shotgun barrel. A second externally threaded portion is provided on the carrier tube which will remain exposed beyond the muzzle end of the shotgun barrel when the carrier tube is fully threaded into engagement with the shotgun barrel. An internally threaded stand-off tube is also provided which is sized to be threadingly carried on an outside of the carrier tube and to engage the second externally threaded portion of the carrier tube such that the stand-off tube can be threaded onto the carrier tube until the stand-off tube abuttingly engages the muzzle end of the shotgun barrel.

20 Claims, 1 Drawing Sheet

FIG. 1
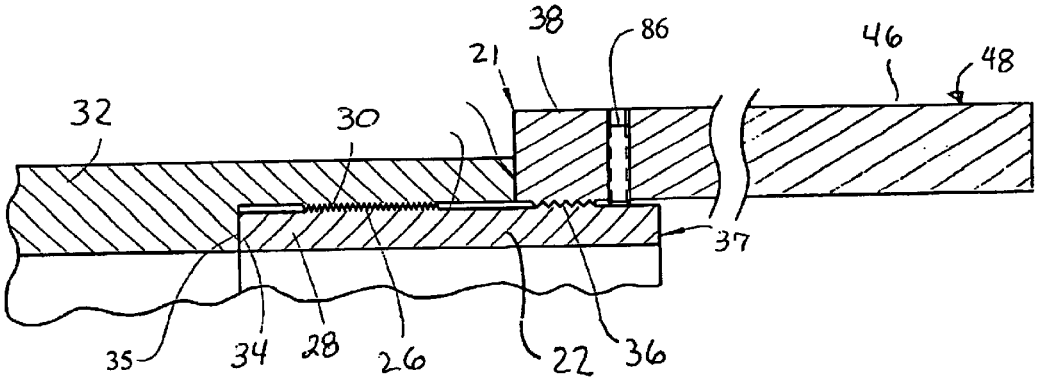
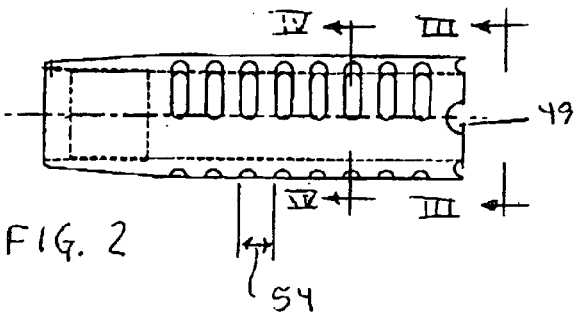
FIG. 2
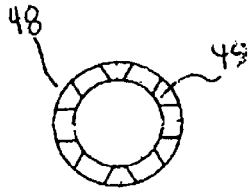
FIG. 3
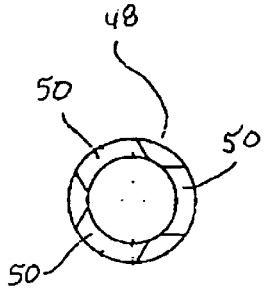
FIG. 4
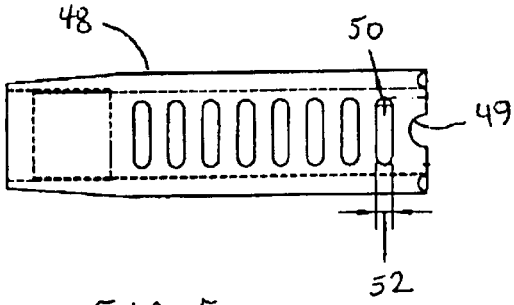
FIG. 5
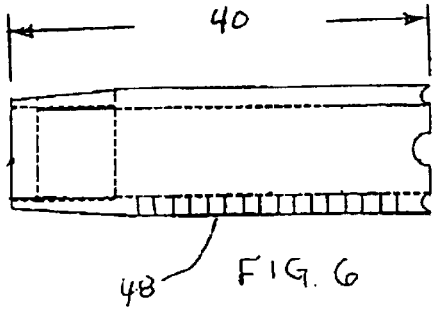
FIG. 6

BREACHING TOOL

BACKGROUND OF THE INVENTION

This invention relates to attachments for a shotgun, and in particular to an attachment for use with the muzzle end of a shotgun barrel.

It is known to use shotguns as breaching tools to disable the hinges or locks of a door to gain entry through an otherwise locked door. Typically such breaching tools have a stand-off arrangement at the muzzle end of the shotgun barrel, either permanently affixed thereto, or threaded onto the fine interior threads in the shotgun barrel.

The stand-off device is generally a cylindrical tube which extends beyond the muzzle end of the barrel and contains passages to allow gasses from the fired shotgun shell to exit laterally while permitting the shot from the shell to continue along an axial extension of the barrel to engage the door surrounding the lock or hinge.

In order to use such a stand-off device, it is necessary to thread the device onto the shotgun barrel, and due to the very fine threads provided on the interior of the barrel, this requires a significant amount of time to complete the many rotations of the standoff until it sealingly seats in the barrel. The length of time required to engage and disengage the stand-off has resulted in dedicating a shotgun to only the task of being used as a breaching tool and to prevent the same shotgun from being used in a given law enforcement or military operation for an other purpose.

If the stand-off is made a permanent part of the shotgun barrel, then certainly that shotgun is limited to a single purpose. When a shotgun is limited to a single use, then either additional personnel are required to man the various weapons and tools required for a particular operation, or various personnel are required to carry more than one weapon or tool and are required to change carrying positions and other considerations which can lead to dangerous situations.

Typically the sole means of attachment of these stand-offs is the meshing of the fine thread of the interior of the barrel and the exterior of the stand-off tube. This provides only a single point of attachment and this attachment is secured only by snugging the seating of stand-off tube against the shoulder on the inside of the barrel This single point of attachment, in a cantilevered fashion, is subject to loosening due to vibrations occurring during the firing tube of the shotgun, from recoil, internal pressure and also the passage of the shot charge, wad and propelling gasses, if the stand-off tube is not continuously checked for tightness, a hazardous condition resulting from a loose tube could result. The tube can loosen from its proper position in the bore, by way of the backing-out of its threads or else by lateral vibration and movement. The resulting hazards may include the failure of the stand-off tube-to-bore gas seal, the deformation of the dimensions of stand-off tube, the threads and the bore of the barrel, which can occur with catastrophic result. The instability of such cantilevered seating of the tube also negatively affects the pellet patterning efficiency and consistency of the shotgun stand-off tube even when properly seated.

It would therefore be an improvement in the art if there were provided a means for securing the attachment of the breaching tool that would minimize or prevent the unwanted loosening and lateral instability of the breaching tool.

It would also be an improvement in the art if there were provided a means for attaching breaching tubes, in a stable and secure manner to a shotgun barrel, and to be able to do so in a less time consuming manner than utilizing the fine threaded attachment arrangement provided on the interior of the shotgun barrel.

SUMMARY OF THE INVENTION

It is an object of the present invention to provide a means for securing the attachment of the breaching tool for a shotgun barrel, that would prevent the unwanted loosening of the breaching tool.

It is also an object of the present invention to provide a means for attaching breaching tools, in a secure manner, to a shotgun barrel, in a less time consuming manner than utilizing the fine threaded attachment arrangement provided on the interior of the shotgun barrel.

These objects are inventively achieved in one embodiment where a locking arrangement for a shotgun breaching tool is provided, wherein the shotgun breaching tool comprises a cylindrical carrier tube having a first external threaded portion at one end for threadingly engaging an internal thread in a shotgun barrel which is spaced inwardly of a muzzle end of the shotgun barrel and which firmly seats that first portion of the tube to the bore and seals it. Also, a lateral notch, slot or other device or surface feature may be located at the opposite or forward end of the exposed carrier tube beyond the muzzle end of the shotgun barrel, so as to permit the carrier tube's internal seal and threads to be initially firmly seated and tightened. The stabilizing locking arrangement comprises a second external threaded portion on the carrier cylindrical tube, which second portion will remain exposed beyond the muzzle end of the shotgun barrel when the carrier is fully threaded into engagement with the bore of the shotgun barrel. An internally threaded stand-off tube is provided which is sized to be threadingly carried on an outside of the carrier tube and to engage the second external threaded portion of the carrier tube such that the stand-off tube can be threaded onto the carrier tube until it tightly and abuttingly securely engages the muzzle end of the shotgun barrel, providing an additional seating point adding to the longitudinal, lateral and axial security, seat and stability of the carrier tube.

The objects are inventively achieved in a further embodiment where a carrier tube and stand-off tube assembly for use with a shotgun barrel is provided comprising a cylindrical carrier tube with a first externally threaded portion at one end for threadingly engaging an internal thread in the shotgun barrel which is spaced inwardly of a muzzle end of the shotgun barrel, and a second externally threaded portion which will remain exposed beyond said muzzle end of said shotgun barrel when the carrier tube is fully threaded into engagement with the shotgun barrel. An internally threaded stand-off tube is also provided which is sized to be threadingly carried on an outside of the tube and to engage the second externally threaded portion of the tube such that the stand-off tube can be threaded onto the tube.

Other embodiments provide additional features of the invention as described in greater detail below.

BRIEF DESCRIPTION OF THE DRAWINGS

FIG. 1 is a longitudinal sectional view of an end portion of a shotgun barrel in which the present invention can be utilized and including a longitudinal sectional view of an embodiment of the invention as it is assembled onto the shotgun barrel;

FIG. 2 is a side elevational view of a stand-off tube portion of the breaching tool embodying the principles of the present invention;

FIG. 3 is an end view of the stand-off tube taken generally along the line III—III of FIG. 2.;

FIG. 4 is a cross sectional view of the stand-off tube taken generally along the line IV—IV of FIG. 2;

FIG. 5 is a side elevational view of the standoff tube of FIG. 2.

FIG. 6 is a longitudinal sectional view of the stand-off tube of FIG. 2.

DETAILED DESCRIPTION OF THE PREFERRED EMBODIMENT

FIG. 1 shows, in a partial, longitudinal sectional view, a locking and stabilizing arrangement for a shotgun breaching tool 21, wherein the shotgun breaching tool comprises a cylindrical carrier tube 22 having a first external threaded portion 26 at or near a first end 28 for threadingly engaging an internal thread 30 in a shotgun barrel 32 which is spaced inwardly of a muzzle end 34 of the shotgun barrel. The carrier tube 22 has a smooth interior surface 31 thereof generally as a continuation of the bore diameter of the barrel. As is well known, the shotgun barrel 32 has an internal seat or shoulder 35 adjacent to the internal thread 30 against which the first end 28 of the carrier tube 22 will abut and seal when the carrier tube is fully engaged with the barrel. A surface feature 37 may be applied to the carrier tube 22 to assist in rotating the carrier tube relative to the barrel 32. For example, a slot may be provided to be engaged by a tool. A roughened or non-circular outer circumferential surface may also be provided to enhance manual or tool assisted tightening of the carrier tube 22 on the barrel 32.

The breaching tool 21 further comprises a second external threaded portion 36 on the carrier tube 24. The second portion 36 remains exposed beyond the muzzle end 34 of the shotgun barrel 32 when the carrier tube 22 is fully threaded into engagement with the shotgun barrel and may or may not extend a short distance into the barrel. An internally threaded stand-off tube 38 is provided as a part of the breaching tool 21 which is sized to be threadingly carried on an outside 40 of the carrier tube 22 and to engage the second external threaded portion 36 of the carrier tube 22, such that the stand-off tube 38 can be threaded onto the carrier tube until the stand-off tube abuttingly engages the muzzle end 34 of the shotgun barrel 32 as shown in FIG. 1. When the stand-off tube 38 is snugged up against the muzzle end 34 of the shotgun barrel 32, a second point of attachment, securement and stabilization of the carrier tube 22 to the barrel 32 is achieved. This helps to stabilize the carrier tube 28, to make it less susceptible to vibration and loosening relative to the barrel 32, and the stand-off tube 38 acts as a jam nut to prevent the inadvertent loosening of the carrier tube from the barrel.

The stand-off tube 38 itself can have a variety of constructions and may simply be an internally threaded standoff tube as shown in FIG. 1, or it may be of a "lock nut-type" of construction as is known, with internal features to hold the stand-off tube in place on the threads 36. Also, the stand-off tube 38 may include a locking ring or washer, such as a split ring, as is known. Further, the stand-off tube may be provided with other locking or retarding devices or arrangements, such as one or more set screws 86 drilled and tapped into the stand-off tube radially. Once the stand-off tube 38 is rotated into position, the set screw(s) 86 can be tightened against the exterior surface of the carrier tube 22 so that the stand-off tube 38 will not be able to back off from its engagement with the muzzle 34.

Thus, the stand-off tube 38 prevents the forward-rear, lateral and longitudinal vibration and movement of the carrier tube 22, which is no longer only attached in a cantilevered fashion. This additional locking and stabilizing stand-off tube, over time, protects the gun barrel 32 and its threads 30, and the carrier tube 22, from wear, mutilation and possible failure which could be caused by motion of the carrier tube relative to the barrel (work hardening) and keeps the carrier tube more securely and firmly aligned in its proper "directly straight ahead" position within the bore of the barrel. Further, the use of the locking and stabilizing stand-off tube 38 protects the internal dimensions of the carrier tube 22, and prevents the rear skirt seal 35 from being work-hardened out of round or being directly contacted by the shot charge metal and thereby marred, mutilated or worn-away. If a carrier tube 22 were to tilt slightly in the barrel 32, it would allow and direct the shot metal to collide with and bear directly upon the internal surface of the tube, which could cause it to be eroded. Further, carrier tube tilt could cause the rear seating skirt to become off-center, and to thus protrude slightly into the bore itself, and the path of the approaching shot column. If a shotgun shell were to be fired after such a condition occurs, internal bore pressures could increase to a point which might cause the carrier tube and barrel to separate or to cause the barrel to rupture, either of which would be costly and dangerous.

In an embodiment of the invention, the stand-off tube 38 has a round outer circumference 46. In some embodiments the stand-off tube 38 has an outer surface configuration 48 which enhances manual manipulation of the stand-off tube. For example, the outer circumference 46 may be knurled. In another embodiment the outer circumference 46 may have a non-circular configuration, which preferably is a regular polygonal shape, such as a square or hexagonal shape. A free end of the stand off tube may be provided with recesses, such as semi-circular recesses 49 assisting in the release of gasses.

The stand-off tube 38 has an axial length greater than the protruding portion of the carrier tube 22, such that when the stand-off tube is threaded onto the carrier tube and into engagement with the muzzle end 34, the stand-off tube will extend beyond the carrier tube in a direction away from the muzzle. Preferably the stand-off tube 38 has a length 40 of between approximately 2 and 8 inches.

The stand-off tube 38 incorporates a series of lateral openings 50 therethrough to allow gasses from the interior of the shotgun barrel to escape laterally when the free end of the stand-off tube is pressed against a door or other structure. These openings 50 may comprise a series of laterally extending slots and a plurality of such slots may extend around the circumference of the tube 38, such as three spaced apart slots ringing the tube at each axial location as shown in the cross section of FIG. 4. Further a series of lateral slots can extend along the length of the tube. In an embodiment, the openings 50 may have a longitudinal dimension 52 (FIG. 5) of between approximately 0.075 and 0.300 inches and each may extend through an angle of between approximately 80 and 160 degrees around the circumference of the stand-off tube, depending on the number of openings at each longitudinal position. Longitudinally, the openings 50, in an embodiment, may be spaced apart such that their centers are spaced a distance 54 between approximately 0.15 and 0.65 inches apart. The openings 50 may also be of other shapes, including square, rectangular, oval and round, or other shapes. The walls forming the openings may extend perpendicular to the outer wall surface of the stand-off tube, or may angle forwards or backwards, to give a desired effect, as is known.

As shown in FIG. 1, the second external threaded portion 36 has a thread pitch courser than the fine thread pitch of the first external threaded portion 26. This means that the stand-off tube 38 will move axially a greater distance for each revolution of the stand-off tube on the carrier tube 22 than the axial distance the carrier tube will move for each revolution of the carrier tube relative to the shotgun barrel 32. Thus, a given axial length of the stand-off tube 38 can be captured on the second threaded portion 36 with fewer rotations of the stand-off tube relative to the carrier tube 22 than are required to capture the same axial length of the carrier tube on the shotgun barrel at the first threaded portion 26. This allows the stand-off tube 38 to be quickly assembled onto the carrier tube 22 and to be moved into a snug engagement with the muzzle end 34 of the shotgun barrel 32. For example, it may take 20 full rotations of the carrier tube 22 (taking up to a minute) to fully seat in the shotgun barrel, but only 2 full rotations of the stand-off tube 38 (taking only a few seconds) to be snugged up against the muzzle 34.

In a further embodiment of the invention, the second external threaded portion 36 has a thread of opposite hand compared to the first external threaded portion 26. Thus, as either the stand-off tube 38 or the carrier tube 22 is vibrated to rotate in one rotational direction, the other tube will be further tightened by such rotation and hence will prevent loosening of the breaching tool.

Thus, the present invention provides a novel method of locking a breaching tool to a shotgun barrel 32 comprising the steps of inserting a carrier tube into the shotgun barrel, rotating the carrier tube relative to the shotgun barrel to engage a threaded connection 26, 30, between the carrier tube and the shotgun barrel, continuing the relative rotation between the carrier tube and the shotgun barrel until the carrier tube abuttingly engages and seals with an internal step 35 in the shotgun barrel, positioning a stand-off tube 38, around an exterior 40, of the carrier tube, rotating the stand-off tube relative to the carrier tube to engage a threaded connection 36 between the carrier tube and the stand-off tube, and continuing the relative rotation between the carrier tube and the stand-off tube until the stand-off tube abuttingly engages a muzzle end 34 of the shotgun barrel.

Although the present invention has been described with reference to a specific embodiment, those skill in the art will recognize that changes may be made thereto without departing from the scope and spirit of the invention as set forth in the appended claims.

As is apparent from the foregoing specification, the invention is susceptible of being embodiment with various alterations and modifications which may differ particularly from those that have been described in the preceding specification and description. It should be understood that we wish to embody within the scope of the patent warranted hereon all such modification as reasonably and properly come within the scope of our contribution to the art.

What is claimed is:

1. A breaching tool for a shotgun, wherein said breaching tool comprises a cylindrical carrier tube having a first external threaded portion at one end for threadingly engaging an internal thread in a shotgun barrel which is spaced inwardly of a muzzle end of the shotgun barrel, a second external threaded portion on said carrier tube, which second portion will remain exposed beyond said muzzle end of said shotgun barrel when said carrier tube is fully threaded into engagement with said shotgun barrel, and an internally threaded stand-off tube sized to be threadingly carried on an outside of said carrier tube and to engage said second external threaded portion of said carrier tube, such that said stand-off tube can be threaded onto said carrier tube until the stand-off tube abuttingly engages said muzzle end of said shotgun barrel, said stand-off tube having a plurality of lateral openings therethrough.

2. The breaching tool according to claim 1, wherein said stand-off tube has a round outer circumference.

3. The breaching tool according to claim 1, wherein said stand-off tube has an outer surface configuration which enhances manual manipulation of said standoff tube.

4. The breaching tool according to claim 1, wherein said stand-off tube has an axial length greater than a remaining exposed portion of said carrier tube, such that when said stand-off tube is threaded onto said carrier tube and into engagement with said muzzle, said stand-off tube will extend beyond said carrier tube in a direction away from said muzzle.

5. The breaching tool according to claim 1, wherein said openings comprise laterally extending slots.

6. The breaching tool according to claim 5, wherein a plurality of said slots are arranged laterally around a circumference of said stand-off tube.

7. The breaching tool according to claim 5, wherein a plurality of said slots are arranged longitudinally along a portion of said stand-off tube.

8. The locking arrangement according to claim 1, wherein said second external threaded portion has a coarser thread pitch than a thread pitch of said first external threaded portion.

9. The locking arrangement according to claim 1, wherein said second external threaded portion has a thread of opposite hand compared to the first external threaded portion.

10. A breaching tool assembly for use with a shotgun barrel comprising:

a cylindrical carrier tube with a first externally threaded portion at one end for threadingly engaging an internal thread in said shotgun barrel which is spaced inwardly of a muzzle end of said shotgun barrel, a second externally threaded portion which will remain exposed beyond said muzzle end of said shotgun barrel when said carrier tube is fully threaded into engagement with said shotgun barrel, and an internally threaded stand-off tube sized to be threadingly carried on an outside of said carrier tube and to engage said second externally threaded portion of said carrier tube such that said stand-off tube can be threaded onto said carrier tube until said stand-off tube abuttingly engages said muzzle end of said shotgun barrel, said stand-off tube having a plurality of laterally extending openings therethrough.

11. The breaching tool assembly according to claim 10, wherein said stand-off tube has a round outer circumference.

12. The breaching tool assembly according to claim 10, wherein said stand-off tube has an outer surface configuration which enhances manual manipulation of said stand-off tube.

13. The breaching tool assembly according to claim 10, wherein said stand-off tube has an axial length greater than a remaining exposed portion of said carrier tube, such that when said stand-off tube is threaded onto said carrier tube and into engagement with said muzzle, said stand-off tube will extend beyond said carrier tube in a direction away from said muzzle.

14. The breaching tool according to claim 10, wherein said openings comprise laterally extending slots.

15. The breaching tool according to claim 14, wherein a plurality of said slots are arranged laterally around a circumference of said stand-off tube.

16. The breaching tool according to claim 14, wherein a plurality of said slots are arranged longitudinally along a portion of a length of said stand-off tube.

17. The breaching tool assembly according to claim 10, wherein said second external threaded portion has a coarser thread pitch than a thread pitch of said first external threaded portion.

18. The breaching tool assembly according to claim 10, wherein said second external threaded portion has a thread of opposite hand compared to the first external threaded portion.

19. The breaching tool assembly according to claim 10, wherein said carrier tube comprises a surface feature to assist in rotating the carrier tube relative to the barrel.

20. A method of attaching a breaching tool to a shotgun barrel comprising:

inserting a carrier tube into said shotgun barrel;

rotating said carrier tube relative to said shotgun barrel to engage a threaded connection between said carrier tube and said shotgun barrel;

continuing said relative rotation between said carrier tube and said shotgun barrel until said carrier tube abuttingly engages an internal step in said shotgun barrel;

position a stand-off tube around an exterior of said carrier tube;

rotating said stand-off tube relative to said carrier tube to engage a threaded connection between carrier tube and said stand-off tube, continuing said relative rotation between said carrier tube and said stand-off tube until said stand-off tube abuttingly engages a muzzle end of said shotgun barrel.

* * * * *